US006229270B1

(12) United States Patent
Stephenson et al.

(10) Patent No.: US 6,229,270 B1
(45) **Date of Patent: *May 8, 2001**

(54) VARIABLE HIGH FREQUENCY LAMP CONTROLLERS AND SYSTEMS

(75) Inventors: John Peter Stephenson, Berkshire; George Alan Limpkin, Hertfordshire, both of (GB)

(73) Assignee: InDigitale Limited (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/463,279

(22) PCT Filed: Jul. 29, 1998

(86) PCT No.: PCT/GB98/02267

§ 371 Date: Jan. 26, 2000

§ 102(e) Date: Jan. 26, 2000

(87) PCT Pub. No.: WO99/07190

PCT Pub. Date: Feb. 11, 1999

(30) Foreign Application Priority Data

Jul. 29, 1997 (GB) ..... 9715992

(51) Int. Cl.[7] ..... G05F 1/00

(52) U.S. Cl. ..... 315/291; 315/209 R; 315/226; 315/278; 315/244

(58) Field of Search ..... 315/209 R, 291, 315/307, 247, 193, 226, 287, 244, 276, 278

(56) References Cited

U.S. PATENT DOCUMENTS

| | | | | |
|---|---|---|---|---|
| 5,055,747 | * | 10/1991 | Johns | 315/307 |
| 5,057,570 | * | 10/1991 | Farrall et al. | 315/248 |
| 5,920,155 | * | 7/1999 | Kanda et al. | 315/307 |

FOREIGN PATENT DOCUMENTS

| | | | |
|---|---|---|---|
| 0189 221 | | 3/1986 | (EP) . |
| 0212 817 | | 4/1987 | (EP) . |
| 0645548 | | 11/1950 | (GB) . |
| 0657072 | | 9/1951 | (GB) . |
| 0739045 | | 10/1955 | (GB) . |
| 1084596 | * | 3/1989 | (JP) . |
| 31-76999 | * | 7/1991 | (JP) . |
| WO84/02825 | | 7/1984 | (WO) . |
| WO90/05992 | | 5/1990 | (WO) . |
| WO91/13530 | | 9/1991 | (WO) . |

* cited by examiner

*Primary Examiner*—Haissa Philogene
(74) *Attorney, Agent, or Firm*—Nixon Peabody LLP

(57) ABSTRACT

A high frequency control circuit for a gaseous discharge lamp which includes a mechanically variable reactance device coupled in series with the lamp to control the current fed to the lamp. The mechanically variable reactance device is adjustable by a user to alter the intensity of the light emitted by the lamp.

9 Claims, 5 Drawing Sheets

VARIABLE HIGH FREQUENCY LAMP CONTROLLERS AND SYSTEMS

FIELD OF THE INVENTION

This invention relates to the control of gaseous discharge lamps, such as fluorescent lamps, and more particularly to the adjustment of the intensity of their light output.

BACKGROUND OF THE INVENTION

Fluorescent lamps have been the commonest method of lighting consumer, commercial and industrial areas for many years. In operation, a gas mixture enclosed in the glass tube of the lamp is ionised by means of a high voltage pulse applied between two heated electrodes at each end of the tube. In a conventional lighting system, the gas in the fluorescent tube is extinguished and then ionised again with each half cycle of the 50 Hz conventional line frequency. This system has the merit of low capital cost and simplicity, but whilst far superior to incandescent lamps in the conversion of energy to light, it is nonetheless an inefficient mechanism. The circuit watt losses are similar whatever the wattage of the lamp and range from about 66% for an 18 watt lamp to 20% for a 70 watt lamp. In addition, the flicker caused by the re-ionisation of the lamp every half cycle at 50 Hz is now recognized as a major cause of headaches amongst office workers.

In consequence, a number of improvements have been initiated over the years to reduce the inefficiency and the flicker associated with fluorescent lamps.

An electronic controller addresses a number of these problems. It supplies the gases in the tube with a high frequency AC current, preferably above 18 kHz. This type of controller typically reduces circuit losses from the range 20–66% to the range 4–8%. Owing to the high frequency refresh rate of the lamp, its light output is increased. Accordingly, lamps are commonly under-powered such that the same output is produced as that resulting when running the lamp with a standard mains frequency circuit. For example:

| | |
|---|---|
| Standard Circuit | |
| Lamp wattage: | 18 watts |
| Circuit losses: | 12 watts |
| Total power consumption: | 30 watts |
| High Frequency Circuit | |
| Lamp wattage: | 16 watts |
| Circuit losses: | 2 watts |
| Total power consumption | 18 watts |

The lumens output of each lamp in the above example would be identical.

The use of a high frequency controller is also beneficial as the refresh rate of the lamp is effectively 60,000 a second when running at 30 kHz, for example. Therefore, there is no flicker detectable by the human eye. Also the electronic controller unit can be less than half the weight of a standard circuit, and generate less heat. An electronic controller is also more versatile. For example, it can be interfaced with passive infra-red movement detectors or optical sensors which detect ambient light levels.

It is generally desirable to include a dimming facility in a lighting system, as the required lighting level may vary depending on various factors. For example, an office may be converted to intensive computer use, and a lower level of lighting is then appropriate owing to the relative dimness of a computer screen. Also, it has been found that the light tolerance and the amount of light needed or felt to be needed for given tasks varies greatly between individuals. In particular, it varies considerably between different age groups. 50–60 year olds will require substantially more light for the same range of tasks as 18–25 year olds. In addition, the light required within open plan and cellular offices varies greatly according to the type of partitioning system, colours and furniture used. Furthermore, office layout designs are changed frequently and in large organisations this can affect as much as 20% of the office space per annum. In consequence the original lighting can be either too bright or too dim in the revised spatial layout.

The abstract of JP-A-01084596 describes control circuitry for a discharge lamp, in which a variable inductance is provided to control the light output of the lamp.

Various forms of dimmable high frequency electronic controllers are available which can reduce their operating wattage from 100% to about 5%. Typically, a wall mounted potentiometer operable by a user is provided to send a control signal to each controller. Each controller accordingly alters the current and frequency which powers the discharge lamps of the respective luminaire. However, such controllers are expensive, typically costing 60% more than a conventional electronic controller. Therefore, it is only worthwhile to link at least ten and usually at least twenty-five luminaires in the dimming circuit, such that light levels can only be adjusted over large areas and in a uniform manner. Furthermore, in such a configuration, wiring needs to be routed from the wall mounted potentiometer to each luminaire in turn to carry the control signal. Installing this wiring is a time-consuming process, particularly when refurbishing a building having existing partitions, fixtures and the like.

SUMMARY OF THE INVENTION

The present invention provides high frequency control circuitry for a plurality of gaseous discharge lamps, comprising a plurality of mechanically variable inductive reactance means, each reactance means being adapted to be connected in series with at least one gaseous discharge lamp to control the current fed to said lamp, the reactance means being adjustable by a user to alter the intensity of the light emitted by said lamp, and wherein each reacance means comprises a coil having a plurality of tappings spaced along its length and a switch for selectively connecting to one of the tappings, the circuitry further comprising a linkage connecting the respective switches of the reactance means such that adjustment of one switch produces a corresponding adjustment of the other switches.

Accordingly, the invention enables individually adjustable control circuits to be produced with little additional cost compared to a circuit without an adjustment facility. The additional cost may therefore be recouped relatively quickly through energy saving by dimming lights as necessary.

It may also allow the lighting level of individual luminaires to be varied above and below their standard fluorescent lamp wattage. Conversely, known dimming systems can only be used to reduce light levels from the standard wattage.

In a preferred arrangement, the circuitry includes a drive oscillator and the high frequency output of the drive oscillator is applied across a two-wire bus bar. A respective sub-circuit comprising starting means, constant inductive reactance means, variable inductive reactance means and output means is provided for each lamp, each sub-circuit being connected across the bus bar. The lamps are individually controllable, but are driven from one control unit with only the sub-circuit being replicated for each lamp.

Embodiments of the invention will now be described by way of example with reference to the accompanying drawings in which:

DETAILED DESCRIPTION

Figure 1:
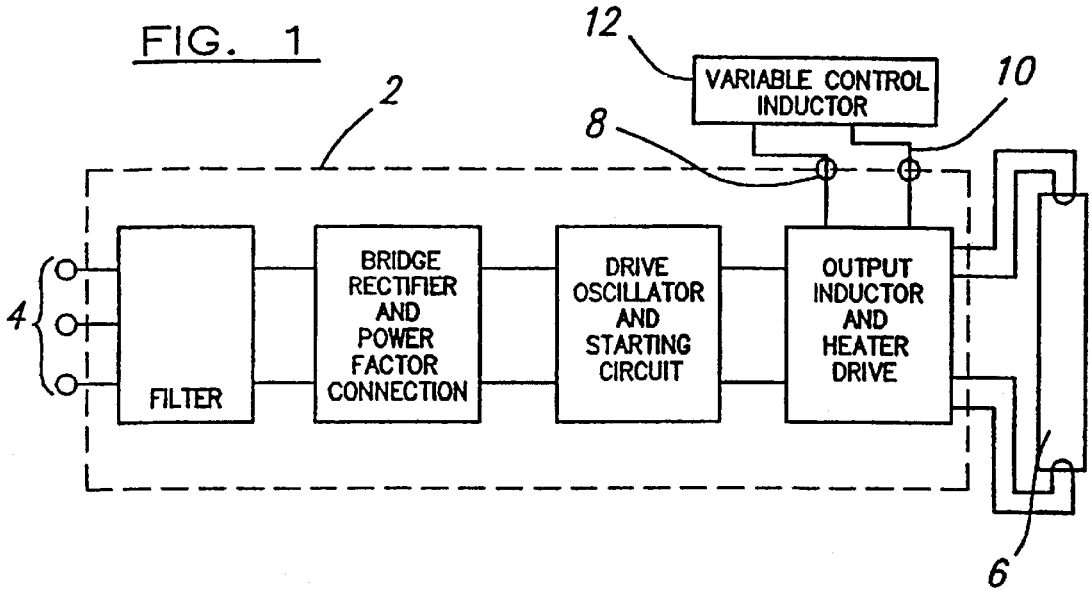
FIG. 1 is an overall block diagram for an electronic high frequency controller circuit according to the invention.

FIG. 1 is a block diagram illustrating the primary features of a high frequency controller in accordance with the invention. The blocks representing features of a conventional electronic controller are enclosed by a dotted line 2. In operation, the live, neutral and earth lines of an AC power supply are connected to respective inputs 4. A discharge lamp 6, such as a fluorescent lamp, is connected to the output of the controller. According to the invention, two additional inputs 8 and 10 to the output inductor and heater drive block are provided and a variable control inductor 12 is connected thereto.

Figure 2:
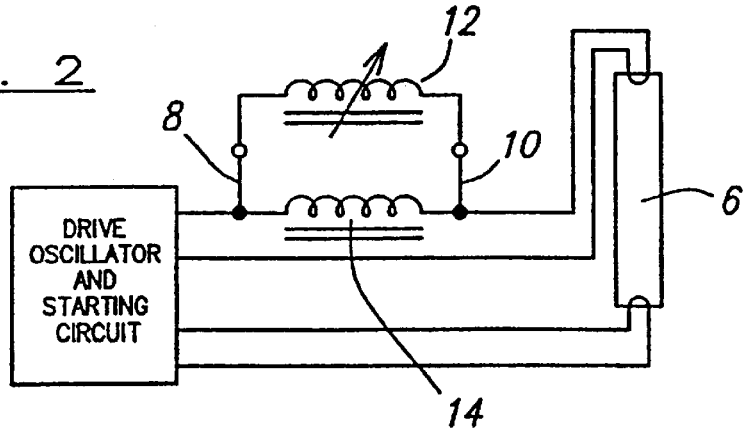
FIG. 2 is the output portion of the controller circuit of FIG. 1.

In a conventional controller, the current input to the lamp 6 is controlled by the inductance of a fixed value inductor 14, shown in FIG. 2. Its value is normally dependent on the frequency and the nominal wattage required to operate the lamp 6. A typical inductance value therefor is 3 mH. In the configuration of the invention shown in FIGS. 1 and 2, the current supplied to the lamp 6 is adjusted by varying the inductance of the inductor 12. This varies the value of the total inductance of inductors 12 and 14 which is in series with the lamp. As a high frequency voltage is used, the inductors may be relatively small in size.

The light output level of the lamp 6 may be varied above and below its standard wattage. For example, a luminaire fitted with a single 58 watt fluorescent lamp using an electronic high frequency controller would normally be installed with the controller running the lamp at 52 watts. Its light output is therefore consistent with that produced by a 58 watt fluorescent lamp, run on a standard mains circuit for 50 Hz operation. If a luminaire is fitted with the controller of this invention, its light output can be increased to 64 watts, for example, that is, by nearly 25%. Thus fewer luminaires may be required to illuminate a given space. Alternatively, where appropriate, such as a change of use of an area from general office purposes to computer use, the variable control inductor 12 can be simply adjusted so that the effective wattage is only 42 watts, say, producing approximately a 20% reduction of the lighting levels. If required, the wattage could be reducible further, to as low as 28 watts, say. Nevertheless, this will still give individuals the option to use higher light levels if desired. The controller of the invention also enables a user to compensate for deterioration in the output of a lamp by increasing the input power.

In this way, the variable control inductor is capable of controlling a 58 watt fluorescent lamp between 42 and 64 watts, for example. Similarly, a range of control can be facilitated with any type of fluorescent lamp.

Figure 3:
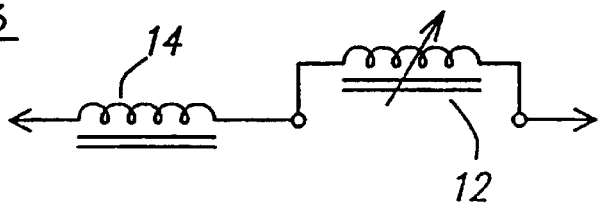
FIG. 3 is a series inductor configuration of the invention.

FIG. 3 shows an alternative inductor configuration to that of FIG. 2, wherein the variable inductor 12 is connected in series with the fixed value inductor 14. This serves to reduce the wattage of the lamp 6 for energy saving applications, whereas the arrangement of FIG. 2 enables adjustment of the supplied power above and below the nominal lamp wattage. If a 3 mH fixed value inductor is used, for example, a variable inductor connected in series may be used having a maximum inductance of about ½ mH, or about 3 mH if connected in parallel. The values selected depend on the power rating of the lamp and the frequency of the applied voltage.

Figure 4:
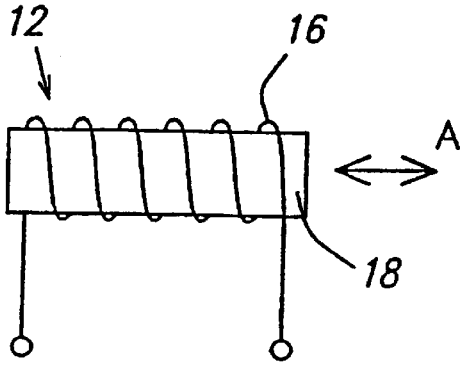
FIG. 4 is a preferred variable inductor for the circuit of FIG. 1.

FIG. 4 shows the construction of a variable inductor 12 of the invention. It consists of a coil 16 and a ferrite rod 18 which are relatively movable to move the rod into or away from the coil in the direction A, increasing and decreasing the inductance of the device, respectively.

Figure 5:
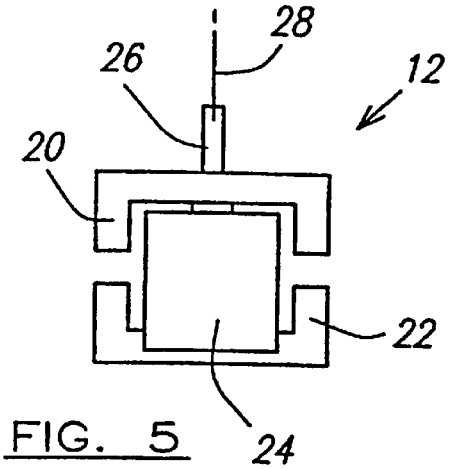
FIG. 5 is another preferred variable inductor.

FIG. 5 shows an alternative variable inductor embodiment. It comprises two E-shaped ferrite cores 20 and 22, a coil 24 and a mechanical linkage 26. The core 22 is fixed, whilst the linkage is operable to move the core 20 relative thereto. Moving the core 20 closer to core 22 reduces the air gap therebetween and increases the inductance of the device, thus reducing the power fed to a lamp 6. Conversely, moving the core 20 away from core 22 increases the power supplied. The linkage may enable adjustment of the core spacing either by movement thereof parallel to or about its axis 28.

The variable control inductor 12 may be fitted to a luminaire internally or externally depending on the type of access required. It may be configured to provide linear or non-linear adjustment of the lamp light level.

Configurations other than those of FIGS. 4 and 5 are envisaged, for example using U- or I-shaped cores with, in each case, the inductance being varied by moving the ferrite material relative to a coil.

Figure 6:
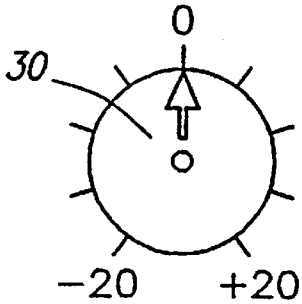
FIG. 6 is a control dial for a variable inductor.

Adjustment of the level of power fed to the luminaire may be provided economically by a mechanical control. FIG. 6 illustrates a control dial for a variable inductor of the invention. Rotation of the dial 30 allows the power fed to a lamp and therefore its light output to be adjusted by ±20%, for example. Alternatively, control may be achieved electronically via a remote control and infra-red link, for example.

Figure 7:
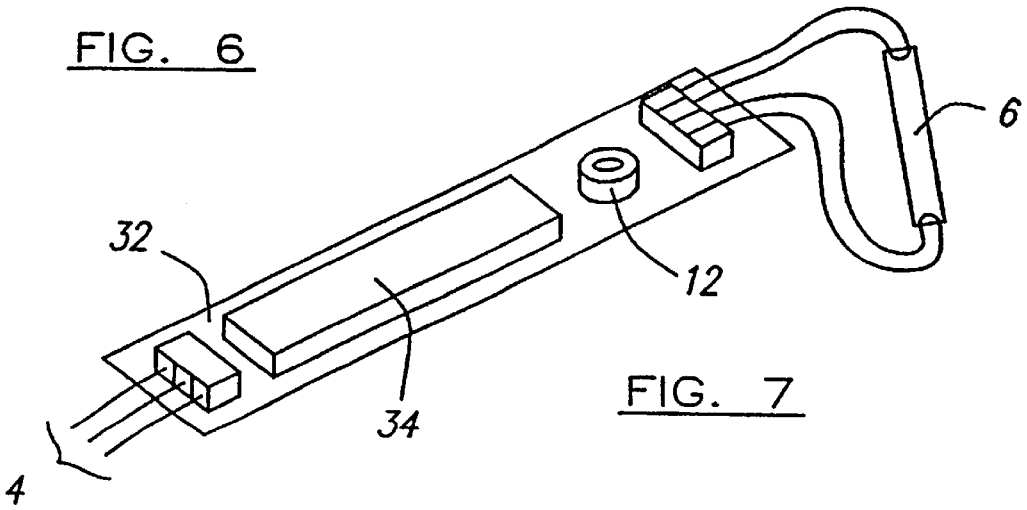
FIG. 7 is a perspective view of a controller circuit of the invention.

FIG. 7 shows a high frequency controller adapted in accordance with the invention. It consists of a circuit board 32 on which known high frequency controller circuitry 34 is mounted. A variable inductor 12 is appropriately connected to the circuitry 34 and provided on the board to form a single unit for controlling the lamp 6.

Figure 8:
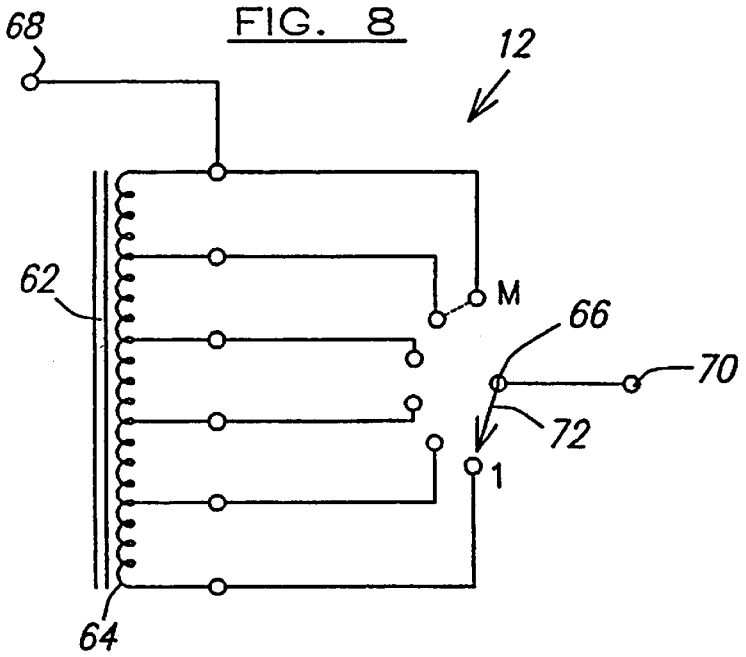
FIG. 8 is a further preferred variable inductor for the circuit of FIG. 1.

A further preferred inductor configuration is shown in FIG. 8. It consists of a core 62, a tapped coil 64 and a selector switch 66. One end of the coil 64 is connected to an input 68 and one terminal of the switch 66 is connected to an output 70. Although the illustrated coil includes six tappings, the number of tappings "m" may be greater or fewer as appropriate to give finer or coarser control. The inductance between adjacent tappings may be varied by altering the number of turns of the coil in each section. Rotation of the switch 66 brings connector 72 into contact with each tapping in turn. Accordingly, the inductance connected between input 68 and output 70 is variable in intervals between a maximum at position "1" and zero at the last position, "m".

Figure 9:
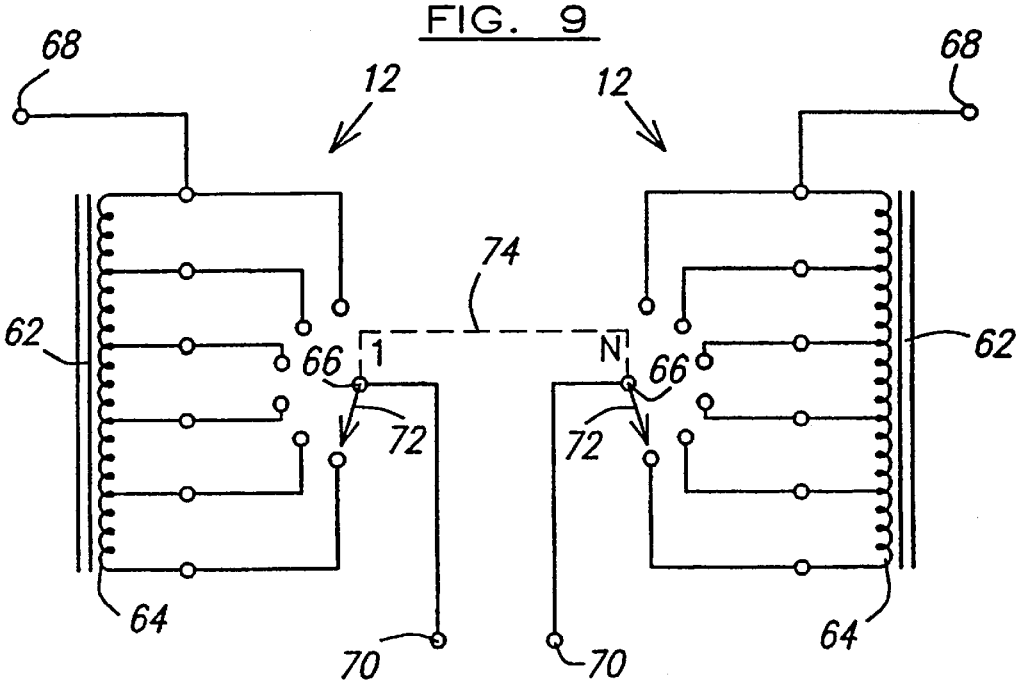
FIG. 9 shows linkage of inductors of the type shown in FIG. 8.

FIG. 9 illustrates an arrangement in which inductors of the type shown in FIG. 8 are linked together. This may be desirable in applications where it is necessary to vary equally groups of lamps being run from a corresponding number, from "1" up to "N", of high frequency controllers. The switches 66 of the inductors are connected by a linkage 74 which, economically, may operate mechanically. The linkage operates so that adjustment of one switch 66 produces a corresponding adjustment of the other switches linked thereto.

Figure 10:
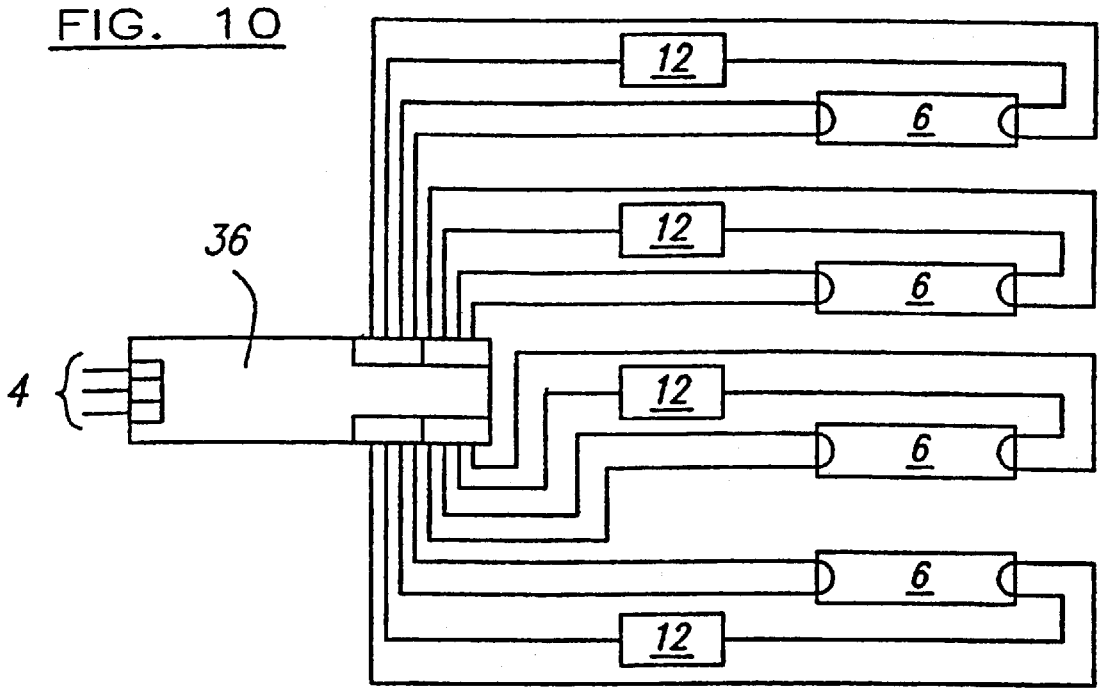
FIG. 10 is a circuit diagram of a controller circuit of the invention in combination with a plurality of discharge lamps.

A lighting system is illustrated in FIG. 10 which enables a plurality of lamps to be individually adjustable. The controller 36 is of another known configuration and such controllers may be adapted to drive up to four lamps 6. A variable inductor is connected between the controller 36 and each lamp 6, allowing the current supplied to each lamp (and therefore its brightness) to be separately altered.

Figure 11:
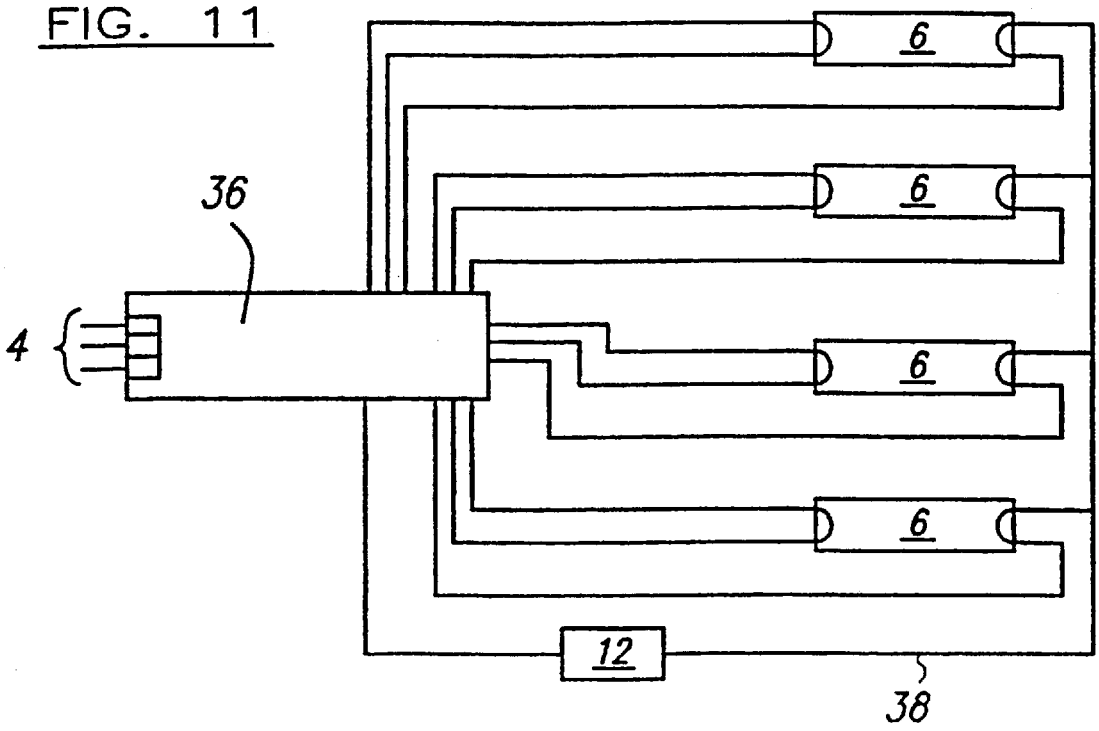
FIG. 11 is a circuit diagram of an alternative embodiment to that of FIG. 10.

A similar arrangement to that of FIG. 10 is shown in FIG. 11. In this case, the four lamps 6 have a common return line 38 to the controller 36. A single variable inductor 12 is connected in the return line, such that the light level of all the lamps is simultaneously adjustable.

Figure 12:
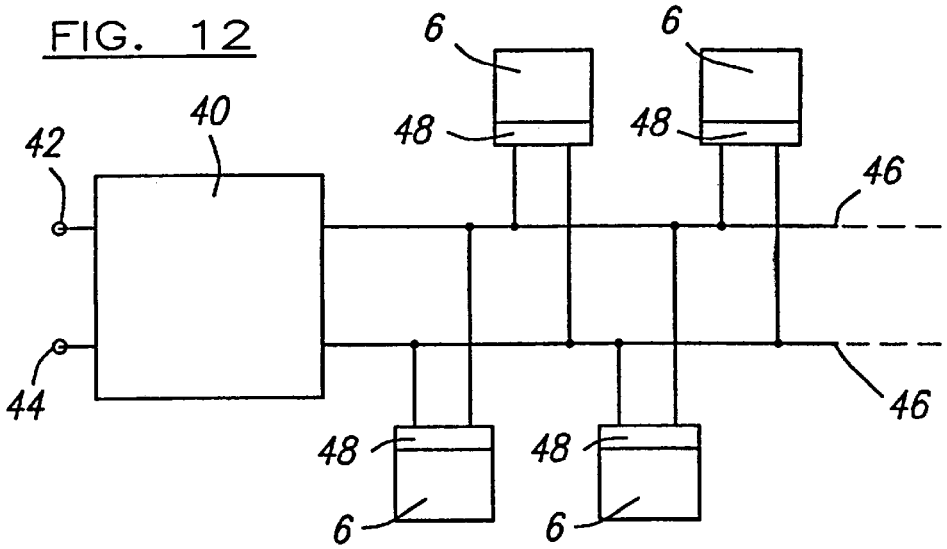
FIG. 12 is a block diagram of another controller circuit of the invention.
Figure 13:
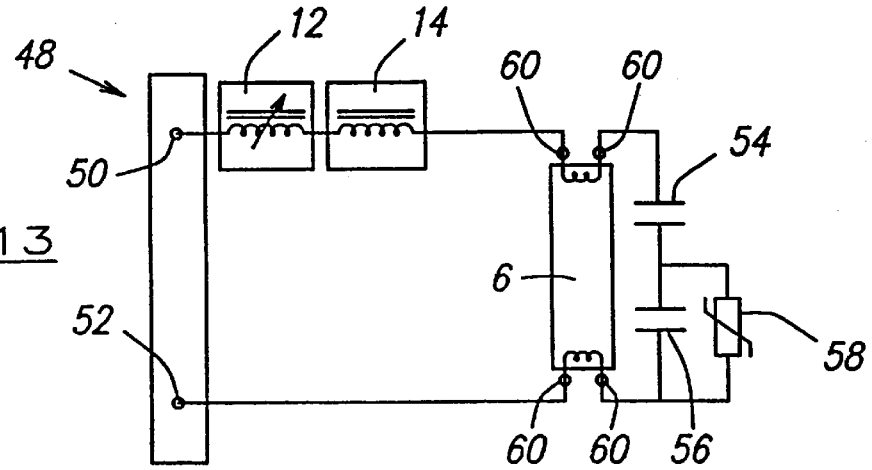
FIG. 13 is a circuit diagram of sub-circuit 48 of FIG. 12.
Figure 14:
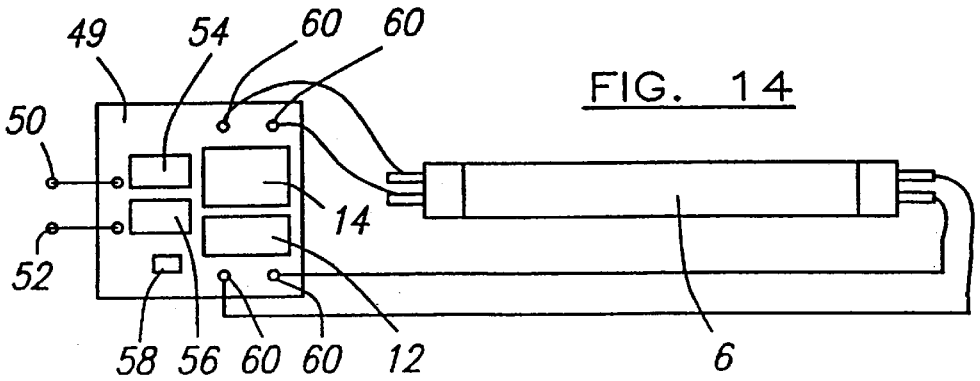
FIG. 14 is a plan view of sub-circuit 48 of FIG. 12 mounted on a circuit board, and a lamp 6.

A further controller circuit configuration of the invention is shown in FIGS. 12 to 14. It consists of a main control unit 40 which receives an AC supply on inputs 42 and 44 and provides an output across a two-wire high frequency bus bar 46. Each of a plurality of lamps 6 has a respective sub-circuit 48 which is in turn connected across the bus bar 46.

The sub-circuit 48 is shown in greater detail in FIGS. 13 and 14. FIG. 13 is a schematic circuit diagram, whereas FIG. 14 is a plan view of a circuit board 49 and lamp 6. Sub-circuit 48 comprises inputs 50 and 52 for connection to the bus bar 46. One input 50 is connected to constant and variable inductors 14 and 12. Although the inductors are shown in series, they may be arranged in parallel, as discussed above. Lamp starting components, namely capacitors 54, 56 and a thermistor 58, are also included in sub-circuit 48 and connected in a known manner across the lamp 6. The capacitors provide a heater current to start the lamp. The thermistor is initially at a low temperature and therefore has a low resistance, such that the heater current is high. Once the lamp has started, the temperature is higher and the thermistor reduces the heater current. Output points 60 are connected to the lamp 6. The other components of the controller are provided within the high frequency main control unit 40.

Using the configuration of FIGS. 12 to 14, a plurality of individually controlled lamps 6 may be driven from one control unit 40 with only the sub-circuit 48 being replicated for each lamp. Whilst the known controller configuration 36 of FIGS. 10 and 11 can only supply up to four lamps, as it includes only four outputs, the arrangement of FIGS. 12 and 14 allows a greater number of lamps to be supplied, within the constraints of the power supply used. It substantially reduces the amount of wiring required as it is only necessary to run two wires to each lamp, rather than four as shown in FIGS. 10 and 11, and is more versatile as sub-circuits 48 can be selectively connected to or disconnected from the bus bar 46, as required. Although a linear tube 6 is shown in FIG. 14, the control circuitry of the invention may of course be connected to tubes of any shape, size or power rating.

What is claimed is:

1. A high frequency control circuit for a plurality of lamps, comprising a plurality of variable inductive reactance devices, each reactance device being adapted to be coupled in series with at least one lamp to control the current fed to said lamp, the reactance device being adjustable by a user to alter the intensity of the light emitted by said lamp, and wherein each reactance device comprises a coil having a plurality of tappings spaced along its length and a switch for selectively connecting to one of the tappings, the circuit further comprising a linkage connecting the respective switches of the reactance device such that adjustment of one switch produces a corresponding adjustment of the other switches.

2. The control circuit of claim 1 wherein a variable inductive reactance device is connected in parallel with a constant inductive reactance means.

3. The control circuit of claim 1 wherein the variable inductive reactance device is connected in series with a constant inductive reactance device.

4. The control circuit of claim 3 comprising a plurality of output devices, each variable inductive reactance device being connected between an output device and a respective lamp.

5. The control circuit of claim 1 comprising a plurality of output devices, each variable inductive reactance device being coupled to a common return line from a plurality of lamps to the control circuitry.

6. The control circuit of claim 1 including a drive oscillator, wherein the high frequency output of the drive oscillator is applied across a two-wire bus bar and a respective sub-circuit comprising a starter, a constant inductive reactance device, the variable inductive reactance device and an output device is provided for each lamp, each sub-circuit being coupled across the bus bar.

7. The control circuit of claim 1 wherein each variable inductive reactance device is adjustable by a user to increase or decrease the power output of said lamp relative to the output of said lamp when supplied via a mains frequency circuit.

8. A luminaire comprising the high frequency control circuit of claim 1.

9. An illuminable sign comprising the high frequency control circuit of claim 1.

* * * * *